US007680439B2

(12) United States Patent
Elbert et al.

(10) Patent No.: US 7,680,439 B2
(45) Date of Patent: Mar. 16, 2010

(54) INTERFERENCE FIT SLEEVED FOAM CHARGE ROLLS AND COMPOSITE MATERIALS

(75) Inventors: Donald Leo Elbert, Lexington, KY (US); Benjamin John Goebel, Lexington, KY (US); Claudia Alexandra Marin, Lexington, KY (US); Ronald Lloyd Roe, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 436 days.

(21) Appl. No.: 11/612,651

(22) Filed: Dec. 19, 2006

(65) Prior Publication Data

US 2008/0145591 A1 Jun. 19, 2008

(51) Int. Cl.
*G03G 15/02* (2006.01)
*G03G 15/20* (2006.01)

(52) U.S. Cl. ..... 399/176; 399/313

(58) Field of Classification Search ..... 399/174, 399/176, 313; 428/71; 361/221, 225
See application file for complete search history.

(56) References Cited

U.S. PATENT DOCUMENTS 5,982,606 A * 11/1999 Masuda et al. ..... 361/225
6,035,163 A * 3/2000 Zona et al. ..... 399/176
7,177,572 B2 * 2/2007 DiRubio et al. ..... 399/176

* cited by examiner

*Primary Examiner*—Sandra L Brase

(57) ABSTRACT

The present invention is generally directed to composite materials or charge rolls comprising a sleeved foam charge roll where the sleeve is interference-fit over the foam core, and methods of constructing them. The foam core can be made with an outer diameter larger than that of the sleeve inner diameter. The sleeve can be interference fit over the foam core to provide a functional charge roll. In some embodiments the charge roll can be used in an image forming apparatus including, but not limited to, an electrophotography system, an electrophotographic copying machine, and a laser printer.

33 Claims, 1 Drawing Sheet

INTERFERENCE FIT SLEEVED FOAM CHARGE ROLLS AND COMPOSITE MATERIALS

The present invention is generally directed to composite materials or charge rolls comprising sleeved foam charge rolls where the sleeve is interference fit over the foam core, and methods of constructing them. The foam core can be made with an outer diameter (OD) larger than that of the inner diameter (ID) of the charge roll sleeve, thereby providing an interference fit to the foam core when it is fastened to the sleeve. When the sleeve is interference fit, it can provide a functional charge roll with no outer layer adhesive between the foam and the sleeve.

In some embodiments the charge roll or composite material is used in an image forming apparatus including but not limited to an electrophotography system, an electrophotographic copying machine, and a laser printer.

BACKGROUND

Charge rolls installed in an image forming apparatus such as an electrophotographic copying machine or printer, are held in contact with a photoconductive (PC) drum for charging the circumferential surface of the PC drum. These charge rolls are used in a so-called "roll charging" method which is one of the known methods for charging a PC drum on which an electrostatic latent image is formed. In the roll charging method, the charge roll to which a charging voltage is applied is held in contact with the outer circumferential surface of the PC drum. The charge roll evenly charges the PC drum before the surface is locally exposed to a laser beam.

In general, charge rolls can include an electrically conductive center shaft (metal core) and an electrically conductive elastic layer which has a low hardness. In some instances, the elastic layer consists of either a foamed body or a solid rubber body whose hardness may be reduced by adding softener. The electrically conductive elastic layer can be formed on the outer circumferential surface of the center shaft with a suitable thickness. Some form of conductive primer or adhesive may be applied to the outer circumferential surface of the shaft before forming the elastic layer. A resistance adjusting layer and a protective layer can be applied to the outer circumferential surface of the conductive elastic layer.

A charge roll with an elastic layer consisting of a solid rubber body can have both a resistance adjusting layer and a protective layer consisting of a polyamide or polyurethane or the like that is spray or dip coated onto the surface of the elastic layer.

In other charge rolls, a foamed rubber can be employed for the elastic layer. When foamed rubber is used some form of adhesive or primer can be applied to the outer circumferential surface of the elastic layer. The resistance adjusting layer and protective layer can be formed as a multilayered sleeve or tube. This sleeve is adhered with the primer or adhesive or shrunk with a process such as heating over the elastic layer to immobilize the sleeve on the elastic layer. Multilayer sleeves or tubes can be produced by extrusion of the base layer and spray or dip coating to produce the outer layer. These process can be costly and can introduce significant variability in the charge roll surface due to the coating process.

Charge rolls constructed with an adhesive or primer on the outer circumferential surface of the elastic layer can also pose problems in controlling the bulk resistivity of the assembled charge roll. In the construction described, the adhesive or primer typically contains conductive additives such as carbon black, ionic salts, or the like. In addition, the method of applying the adhesive or primer in a continuous layer can be costly and is rarely efficient. The presence of adhesive or primer on the sleeve also renders it non-recyclable for future use on a new shaft and elastic layer.

Furthermore, charge rolls constructed with a solid rubber elastic layer have inherently higher hardness and thus can be less compliant. More compliance creates a wider nip, which compensates for problems such as PC drum runout, resulting in better charge roll to PC drum contact. More compliance also reduces the noise generated from the frequency of the AC/DC charge applied to a hollow, metal PC drum. Solid rubber charge rolls can also leach extractables that can contaminate the PC drum surface. The extractables include, but are not limited to, oils, softeners, conductive additives, curatives, and other materials which can be removed from the polymer matrix with solvents which include but are not limited to, methanol, acetone, and chloroform. Solid rubber rolls can be subject to non-uniformities in surface resistance due to thickness variation in the outer layers of the roll which are typically spray or dip coated.

SUMMARY

According to one embodiment of the invention a charge roll is provided. The charge roll comprises a shaft, a foam core layer which surrounds at least part of the circumferential surface of the shaft, and a sleeve which surrounds at least part of the circumferential surface of the foam core layer, and the sleeve is fastened to the foam core layer by interference fit.

According to another embodiment a charge roll comprises a shaft, a foam core layer which surrounds at least part of the circumferential surface of the shaft, and a sleeve which surrounds at least part of the circumferential surface of the foam core layer, and the sleeve is fastened to the foam fore layer by friction after the sleeve and foam core layer are pushed together.

According to another embodiment a composite material is provided. The composite material comprises a shaft, a foam core layer which surrounds at least part of the circumferential surface of the shaft, and a sleeve which surrounds at least part of the circumferential surface of the foam core layer, and the sleeve is fastened to the foam core layer by interference fit.

According to another embodiment, an image forming apparatus is provided. The image forming apparatus comprises a charge roll and a photoconductive drum. The charge roll comprises a shaft, a foam core layer which surrounds at least part of the circumferential surface of the shaft, and a sleeve which surrounds at least part of the circumferential surface of the foam core layer, and the sleeve is fastened to the foam core layer by interference fit.

According to another embodiment a process for constructing a charge roll is provided. The process for constructing charge roll comprises fastening a sleeve to a foam core by interference fitting. The charge roll comprises a shaft, a foam core layer which surrounds at least part of the circumferential surface of the shaft, and a sleeve which surrounds at least part of the circumferential surface of the foam core layer.

BRIEF DESCRIPTION OF THE DRAWINGS

The following detailed description of specific embodiments of the present invention can be best understood when read in conjunction with the following drawings.

Figure 1A:
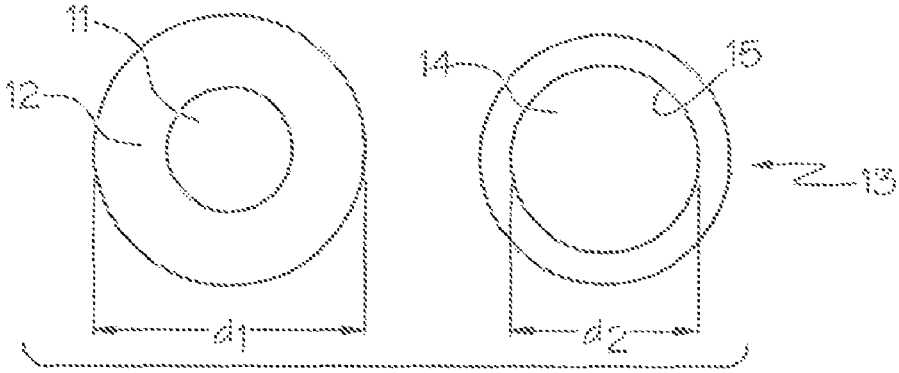
FIG. 1A is an end view illustrating a shaft and a foam core, and a sleeve before fastening the sleeve to the foam core, according to one embodiment of the present invention.

The embodiments set forth in the drawings are illustrative in nature and are not intended to be limiting of the invention defined by the claims. Moreover, the individual features of the drawings of the invention will be more fully apparent and understood in view of the Detailed Description.

DETAILED DESCRIPTION

Reference will now be made in detail to various embodiments which are illustrated in the accompanying drawings, wherein like numerals indicate similar elements throughout the views.

In one embodiment of the present invention, a charge roll is provided which contains a conductive shaft (e.g., a metal core) and a foamed polymer elastic layer, but does not contain adhesive or primer on the outer circumferential surface of the elastic layer. Furthermore, the sleeve used to cover the elastic layer can function as both the resistance adjusting layer and protective layer in a single layer. This construction can be inexpensive to produce and affords more control over the volume resistivity of the assembled charge roll. The sleeve can also be recyclable as no primer or adhesive is used on the sleeve. These charge rolls can prevent teaching extractables onto the PC drum surface and can also provide uniform charge to the PC drum. The charge rolls can be used in both DC only and AC/DC laser printing systems. DC charging systems can use a DC voltage on the charge roll to impart charge to the photoconductor. AC/DC charging systems can use an AC voltage, with a range of frequencies, with a DC offset to impart charge to the photoconductor.

Figure 1B:
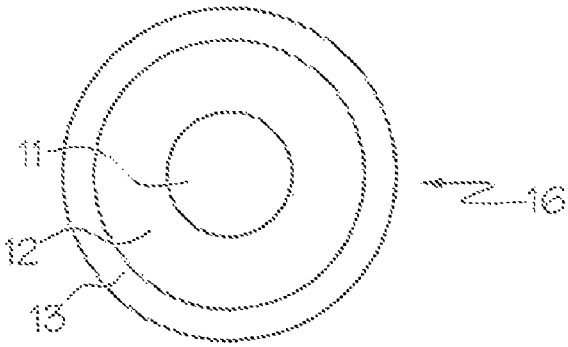
FIG. 1B is an end view illustrating the shaft, the foam core and the sleeve of FIG. 1A after the sleeve has been fastened by interference fit to the foam core, to provide a charge roll, according to one embodiment of the present invention.
Figure 2:
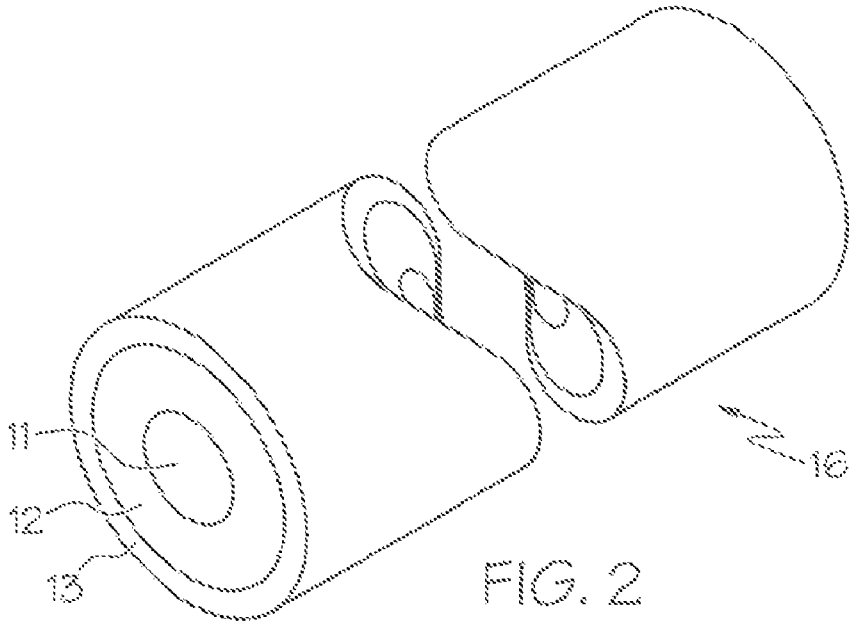
FIG. 2 is a perspective view illustrating the charge roll 16 of FIG. 1B, according to one embodiment of the present invention.

In another embodiment of the invention, FIG. 1 illustrates an end view of the construction of a charge roll, where FIGS. 1A and 1B show the shaft 11, foam core 12 and sleeve 13 before and after fastening the sleeve to the foam core, respectively. Sleeve 13 includes an inner surface 15, wherein the inner surface 15 defines opening 14. Before fastening the outer diameter of the foam core 12 ($d_1$) can be greater than the inner diameter of the sleeve 13 ($d_2$), as shown, for example, in FIG. 1A. Sleeve 13 can be interference fit to the foam core 12 to provide the charge roll 16, as shown, for example, in FIGS. 1B and 2.

In another embodiment, a charge roll comprises a center shaft, an electrically conductive foamed rubber elastic layer formed on the outer surface of the center shaft, and a sleeve that is slid over the elastic layer. The sleeve is a single layer material that can serve as the resistance adjusting layer and the protective layer and is not required to adhere to the foam with adhesive or primer.

In another embodiment of the invention, the center shaft of the charge roll is a ferrous material such as steel and is plated with nickel by a means such as electroless plating. The center shaft can have a cylindrical shape and can have an outer diameter ranging from about 4 mm to about 10 mm. An electrically conductive primer or adhesive can be applied at a thickness of from about 5 μm to about 100 μm to the outer circumferential surface of the shaft. Examples of primers include but are not limited to silanes, Chemlok® 250 (purchased from Lord Corporation), and Thixon® 3437 (purchased from Morton International). Examples of adhesives include but are not limited to epoxy-based conductive adhesives, S04-93 conductive adhesive (purchased from Engineered Materials Systems), heat- or pressure-bondable conductive films, Z-Axis Adhesive Film 7313 (purchased from 3M), Chemlok® 250 (purchased from Lord Corporation), and Thixon® 3437 (purchased from Morton International).

The electrically conductive elastic layer can be formed from any known electrically conductive foam material, so that the elastic layer to be obtained has a hardness within a range of from about 5 degree Shore 00 to about 70 degree Shore 00, depending on foam type and density. The foam material used for providing the electrically conductive elastic layer may be selected from among any known foam materials including, but not limited to, nitrile-butadiene (NBR), hydrogenated NBR, urethane polymer, polyether urethane, polyester urethane, ethylene-propylene terpolymer (EPDM), epichlorohydrin, and other materials that have a sufficient resistance to fatigue of the obtained foam body, and the obtained foam body satisfies the characteristics required for the charge roll.

In another embodiment, the foam material may be inherently conductive or made electrically conductive by adding electrically conductive material to the foam material. The electrically conductive material may contain at least one conductive agent including, but not limited to, carbon black, metal powder, metal oxide, ionic salt, and other agents that provide an elastic layer with a desired volume resistivity value.

A foam tube may be cut from a block of foam material such that the foam ID is slightly smaller than the center shaft OD and the foam OD is larger than the sleeve ID to provide for proper interference with the outer charge roll sleeve.

In some embodiments, the foam may be coated with an electrically conductive slurry, reticulated, or both. The slurry may contain at least one conductive agent including, but not limited to, carbon black, metal powder, metal oxide, ionic salt, and other agents that provide an elastic layer with a desired volume resistivity value.

In some embodiments, when the electrically conductive elastic layer is constructed by the methods described above, the obtained elastic layer may have a volume resistivity of from about $10^2$ ohm-cm to about $10^8$ ohm-cm.

The primer or adhesive coated center shaft may be inserted into the foam tube and the primer or adhesive can be cured by any means such as heating. The foam OD may also be ground by means such as traverse or plunge grinding to obtain a desired OD. In some embodiments, the desired OD is from about 10 mm to about 24 mm.

In some embodiments, the outer layer charge roll sleeve may be formed from any thermoplastic material including, but not limited to, polyamide ether, polyamide (PA), polytetrafluorethylene (PTFE), polyimide (PI), and polyvinylidene fluoride (PVDF), or may be formed from any elastomeric material including, but not limited to, polyurethane, epichlorohydrin, and silicone. The material used for the charge roll sleeve may also be selected from materials that have at least one of sufficient resistance to abrasion, low surface energy, or high tensile strength. The charge roll sleeve may function as both the resistivity adjusting layer and the protective layer.

In another embodiment of the present invention, the sleeve material comprises a material loaded with at least one conductive agent to control resistivity. Conductive agents include, but are not limited to, carbon black, ionic salts, metal oxides, and polyaniline. Conductive agents may be combined with the sleeve material described above to obtain the desired volume and surface resistivity values. The sleeve may be produced by means including, but not limited to, extrusion processes or molding processes. The sleeve may be cured by means such as heating and cut to length after the forming process. The sleeve wall thickness may range from about 50 μm to about 1300 μm, or from about 50 μm to about 300 μm, or from about 120 μm to about 190 μm, or from about 80 μm to about 130 μm.

When the outer charge roll sleeve is constructed as described above, the obtained charge roll sleeve can have a volume resistivity of from about $10^5$ ohm-cm to about $10^{10}$ ohm-cm.

In yet another embodiment, the sleeve is interference fit onto the foam core of the charge roll where prior to the interference fastening the foam core OD is larger than the sleeve ID. The shaft and foam core assembly may be inserted into the charge roll sleeve by means of a hydraulic slide, which pushes the assembly through a fixture, compressing the foam OD to the sleeve ID. Air jets may be used to assist the operation by blowing inside the sleeve as the assembly is inserted. In some embodiments, the sleeve can be heat shrunk.

In some embodiments, there is no primer or adhesive on the outer circumferential surface of the foam core layer or on the inner circumferential surface of the sleeve during one or more of the following time periods: before assembly, during assembly, after assembly, or at any time.

In some embodiments, a single layer thermoplastic sleeve is interference fit on a shaft and foam core assembly to accomplish a low-cost, compliant charge roll for DC or AC/DC laser printing. For example, in some embodiments, a low-density (e.g., from about 0.5 lb/cu ft to about 4 lb/cu ft) foam core (e.g., polyether urethane or polyester urethane) having an OD of from about 13 mm to about 19 mm is adhered to an about 6 mm OD steel shaft, can be inserted into an about 9 mm OD, electrically conductive, thermoplastic sleeve, which is from about 70 μm to about 200 μm thick, to achieve a from about 4 mm to about 10 mm of interference between the foam core and the sleeve, for example. In other embodiments, a higher density foam (e.g., from about 4 lb/cu ft to about 9 lb/cu ft) with less interference (e.g., from about 0.3 mm to about 4 mm) between the foam core and the sleeve can yield a low-cost, compliant charge roll for DC or AC/DC laser printing.

According to some embodiments of the invention, the interference between the foam core OD and the sleeve ID is about 4 mm for low-density foam (e.g., about 2 lb/cu ft). That is, a low-density foam can be employed to construct an about 13 mm OD foam core around an about 6 mm OD shaft. An about 9 mm ID sleeve is slid onto the foam core for about 4 mm interference and minimal mechanical slip.

According to some embodiments of the invention, the interference between the foam core OD and the sleeve ID is about 1 mm for high-density foam (e.g., about 8 lb/cu ft). That is, a high-density foam can be employed to construct an about 10 mm OD foam core around an about 6 mm OD shaft. An about 9 mm ID sleeve is slid onto the foam core for an about 1 mm interference and minimal mechanical slip.

Various example constructions are presented below, but are not intended to limit scope of the claimed invention.

COMPARATIVE EXAMPLE 1

This comparative example represents a set of charge rolls. Components used to make these charge rolls include steel shafts, solid epichlorohydrin (ECO) cores (from about 0% to about 20% carbon black loading), and polyamide coatings, from about 1 μm to about 30 μm thick (from about 0% to about 40% carbon black loading).

Primer is applied to the shaft before molding. Epichlorohydrin (ECO) is molded onto the shaft and heat-cured. The core is ground to the desired OD and profile. The core is then cleaned to remove grinding debris. The core is dip or spray coated with the polyamide solution. The coating is heat dried after application. The ECO core provides charging of the PC drum. The polyamide coating helps protect the PC drum from leaching of ECO onto the surface and provides a protective layer over the tacky, ECO layer. This charge roll is suitable for DC type systems.

COMPARATIVE EXAMPLE 2

This comparative example represents a set of charge rolls. Components used to make these charge rolls include steel shafts, solid EPDM cores (from about 0% to about 30% carbon black loading), optional polyamide coatings, from about 1 μm to about 30 μm thick (from about 0% to about 40% carbon black loading), ECO layers, from about 50 μm to about 250 μm thick (from about 0% to about 20% carbon black loading), and polyamide coatings, from about 1 μm to about 30 μm thick (from about 0% to about 40% carbon black loading).

Primer is applied to the shaft before molding. EPDM is molded onto the shaft and heat-cured. The core is ground to the desired OD and profile. The core is then cleaned to remove grinding debris. The core is dip or spray coated with an ECO solution. The ECO layer is heat cured. The composite core is spray or dip coated with polyamide solution. The coating is heat cured. The EPDM provides a conductive core. The ECO layer functions as the resistivity-adjusting layer. The polyamide coating helps protect the PC drum from leaching of ECO onto the surface and provides a smooth layer over the tacky, ECO layer. This charge roll is suitable for AC/DC-type systems but would function in DC type systems.

COMPARATIVE EXAMPLE 3

This comparative example represents a set of charge rolls. Components used to make these charge rolls include steel shafts, reticulated polyether urethane foam cores (carbon black coated); and two-layer sleeves, from about 50 μm to about 100 μm total thickness (inner layer: silicon with caprolactone beads, outer layer: polyamide).

This example construction is available in a completing product and thus could not be readily tested using available equipment. There is a shaft on which there exists an adhesive layer. A foam core is used for the elastic layer. The foam core is the desired OD, or slightly smaller than about 12 mm. A two-layer, beaded silicone/polyamide sleeve surrounds the shaft and core assembly. The polyamide exists as a coating over the silicone layer of the sleeve. Adhesive exists between the foam core and the multi-layer sleeve. This charge roll is suitable for AC/DC-type systems but would function in DC type systems.

EXAMPLE 4

This example represents a set of charge rolls made with PVDF sleeve interference fit onto a foam core according to some embodiments of the present invention. Components used to make these charge rolls include steel shafts, polyether urethane foam cores (some with carbon black coatings); and PVDF tubes (with ionic additive), from about 120 μm to about 190 μm.

A foam tube was cut from a large block of foam. Foams used include about 8 lb/cu ft reticulated polyurethane foam or about 2 lb/cu ft reticulated polyurethane foam purchased from Foamex International Inc. Carbon black coatings were applied to the foams by Rogers Foam Corporation. An epoxy-based, conductive adhesive (e.g., 504-93 conductive adhesive purchased from Engineered Materials Systems) was applied to the shaft. The shaft was then inserted into the tube and the adhesive was heat-cured. The foam core was ground to the desired OD, from about 10 mm to about 24 mm. The PVDF sleeve was extruded and cut to a length from about 1 mm to about 4 mm longer than the foam length on each end of the roll to prevent exposure of electrically conductive foam to the PC drum. Some PVDF sleeves were purchased from Gunze. The foam core and shaft assembly was inserted into the PVDF sleeve, positioned, and held in place by interference fit. These charge rolls can be used in an AC/DC-type system or in a DC system.

EXAMPLE 5

This example represents a set of charge rolls made with polyamide ether sleeve interference fit onto a foam core according to some embodiments of the present invention. Components used to make these charge rolls include steel shafts, poly-ether urethane foam cores (some with a carbon black coating), and polyamide ether tubes (with carbon black additive), from about 80 μm to about 130 μm thick.

A foam tube was cut from a large block of foam. Foams used include about 8 lb/cu ft reticulated polyurethane foam or about 2 lb/cu ft reticulated polyurethane foam purchased from Foamex International Inc. Carbon black coatings were applied to the foams by Rogers Foam Corporation. An epoxy-based, conductive adhesive (e.g., 504-93 conductive adhesive purchased from Engineered Materials Systems) was applied to the shaft. The shaft was then inserted into the tube and the adhesive was heat-cured. The foam core as ground to the desired OD, from about 10 mm to about 24 mm. A polyamide ether sleeve was extruded and cut to a length of from about 1 mm to about 4 mm longer than the foam length on each end of the roll to prevent exposure of electrically conductive foam to the PC drum. Some polyamide ether sleeves were purchased from Gunze. The foam core and shaft assembly was inserted into the polyamide ether sleeve and held in place by interference fit. These charge rolls can be used in an AC/DC-type system or in a DC system.

TABLE 1

Characteristics of Charge Rools Described in Comparative Examples 1-3 and Examples 4 and 5

| Characteristic | Comp. Ex. 1 | Comp. Ex. 2 | Comp. Ex. 3 | Example 4 | Example 5 |
|---|---|---|---|---|---|
| DC Horizontal Feathering Defect (fine, sharp, random lines) | 4 | 0 | 0 | 0 | 0 |
| AC/DC White Speckles Defect (on dark background) | N/A | 4 | 0-1 | 0 | 0 |
| Coating Ribbons Defect (non-uniformities) | 4 | 4 | 1-2 | 0 | 0 |
| AC/DC Charge Frequency Noise | N/A | 4 | 1 | 1 | 1 |
| Cost of Production | 3 | 4 | 3-5 | 1 | 1 |
| Compliance | 1 | 2 | 4 | 4 | 4 |

Table 1 summarizes the characteristics of the example charge rolls using a scale value which ranges from zero to five. A scale value of zero indicates no incidence of or a zero value for the characteristic. A scale value of five indicates a high incidence of or large value for the characteristic. Except for Comparative Example 3, the scale values of the characteristics of the charge rolls are determined from testing of charge rolls constructed as described above. The scale values of the characteristics of Comparative Example 3 are based on the characteristics of similarly constructed charge rolls, as described below. The entry "N/A" indicates that the characteristic is not applicable because the charge roll construction is not suitable for AC/DC-type systems.

Comparative Examples 1 and 2 have print defects caused by non-uniformities in the surface layer of the roll because the outer layers were produced by dip or spray coating.

In Comparative Example 3, it is likely that there is some electrical variability due to coating and extrusion roll-construction processes. Coating processes are used when applying the conductive adhesive layer between the foam and sleeve, and when adding the outer layer of the sleeve. An extrusion process is used to make the inner sleeve. The likely electrical variability resulting from these processes suggests an increased rate of coating ribbons defects and to a lesser extent of AC/DC white speckles defects.

The use of foam in Example 3 likely reduces the noise generated from the frequency of the applied AC/DC charge. Part-to-part variation likely increases with each extra layer and process used in the construction, thereby likely increasing roll construction costs for Example 3. The Example 3 rolls are designed for AC/DC applications but would likely function in DC applications.

In example 4, a sleeve is used for the outer layer and provides a consistent surface with little electrical non-uniformity around or along the roll surface. A roll construction without conductive adhesive between the foam and the sleeve eliminates another source of non-uniformity in the outer layers of the charge roll. The use of foam reduces the noise generated from the frequency of the applied AC/DC charge. This charge roll construction is also less expensive as conductive adhesive is usually very expensive and scrap rates are decreased when print quality is not directly dependent on a coating process. These rolls are also acceptable for AC/DC and DC applications, thereby reducing variability between products and effectively lowering cost.

In Example 5, a sleeve is used for the outer layer and provides a consistent surface with little electrical non-uniformity around or along the roll surface. A roll construction without conductive adhesive between the foam and the sleeve eliminates another source of non-uniformity in the outer layers of the charge roll. The use of foam reduces the noise generated from the frequency of the applied AC/DC charge. This charge roll construction is also less expensive as conductive adhesive is usually very expensive and scrap rates are decreased when print quality is not directly dependent on a coating process. The Example 5 rolls are also acceptable for AC/DC and DC applications, thereby reducing variability between products and effectively lowering cost. One potential variation to the Example 5 construction is that an ionic salt may be used as a conductive agent in the sleeve, rather than carbon black. The use of ionic salts may improve voltage sensitivity and electrical conductivity control.

The charge rolls of Example 4 may be a less expensive and a more versatile charge roll than those described in the other examples.

The foregoing description of the various embodiments and principles of the inventions has been presented for the purposes of illustration and description. It is not intended to be exhaustive or to limit the inventions the precise forms disclosed. Many alternatives, modifications, and variations will be apparent to those skilled in the art. For example, some of the principles of the inventions may be utilized in different image forming systems such as, but not limited to electrophotography systems, photocopy machines, and laser printers. Moreover, although many inventive aspects have been presented, such aspects need not be utilized in combination, and various combinations of inventive aspects are possible in light of the various embodiments provided above. Accordingly, the above description is intended to embrace all possible alternatives, modifications, combinations, and variations, and have been discussed or suggested herein, as well as all others that fall within the principles, spirit, and broad scope of the various inventions as defined by the claims.

What is claimed is:

1. A charge roll comprising:

a shaft;

a foam core layer which surrounds at least part of the circumferential surface of the shaft, wherein the foam core layer is reticulated and coated with an electrically conductive composition; and a sleeve which surrounds at least part of the circumferential surface of the foam core layer;

wherein the sleeve is fastened to the foam core layer by interference fit, and wherein prior to fastening the foam core layer to the sleeve, the foam core layer has an outer diameter greater than the inner diameter of the sleeve.

2. The charge roll of claim 1 wherein the sleeve has a length which is greater than a length of the foam core layer by about 1 mm to about 4 mm.

3. The charge roll of claim 1 wherein the foam core layer has a hardness from about 5 degree Shore 00 to about 70 degree Shore 00.

4. The charge roll of claim 1 wherein the foam core layer is selected from the group consisting of nitrile-butadiene rubber, hydrogenated nitrile-butadiene rubber, urethane polymer, ethylene propylene terpolymer, and epichlorohydrin.

5. The charge roll of claim 1 wherein the foam core layer coated with the electrically conductive composition comprises at least one agent selected from the group consisting of carbon black, metal powder, metal oxide, ionic salt, and polyaniline.

6. The charge roll of claim 1 wherein the foam core layer has a volume resistivity from about $10^2$ ohm-cm to about $10^8$ ohm-cm.

7. The charge roll of claim 1 wherein the sleeve functions as a resistivity adjusting layer and a protective layer.

8. The charge roll of claim 1 wherein the sleeve is formed from a composition comprising a thermoelastic material or from a composition comprising an elastomeric material.

9. The charge roll of claim 1 wherein the sleeve is formed from a composition comprising at least one selected from the group consisting of polyamide ether, polyamide, polytetrafluoroethylene, polyimide, polyvinylidene fluoride, polyurethane, epichlorohydrin, and silicone.

10. The charge roll of claim 1 wherein the sleeve comprises at least one agent selected from the group consisting of carbon, black, metal powder, metal oxide, ionic salt, and polyaniline.

11. The charge roll of claim 1 wherein the thickness of the sleeve is one of about 50 μm and about 70 μm.

12. The charge roll of claim 1 wherein the thickness of the sleeve is form about 80 μm to about 130 μm.

13. The charge roll of claim 1 wherein the thickness of the sleeve is form about 50 μm to about 300 μm.

14. The charge roll of claim 1 wherein the thickness of the sleeve is form about 120 μm to about 190 μm.

15. The charge roll of claim 1 wherein the sleeve has a volume resistivity from about $10^5$ ohm-cm to about $10^{10}$ ohm-cm.

16. The charge roil of claim 1 wherein the sleeve inner diameter prior to fastening to the foam core layer is from about 8 mm to about 16 mm.

17. The charge roll of claim 1 wherein the sleeve inner diameter prior to fastening to the foam core layer is from about 3 mm to about 9 mm.

18. The charge roll of claim 1 wherein the foam core outer diameter is from about 10 mm to about 24 mm.

19. The charge roll of claim 1 wherein the foam core density is from about 4 lb/cu ft to about 15 lb/cu ft.

20. The charge roll of claim 1 wherein the foam core density is from about 0.5 lb/cu ft to about 2 lb/cu ft.

21. The charge roll of claim 1 wherein the interference between foam core and the sleeve is from about 4 mm to about 10 mm.

22. The charge roll of claim 1 wherein the interference between foam core and the sleeve is from about 0.3 mm to about 4 mm.

23. The charge roll of claim 1 wherein the shaft outer diameter is about 6 mm;

the foam core layer outer diameter is about 13 mm;

the sleeve inner diameter prior to fastening to the foam core layer is about 9 mm; and the foam core layer density is about 2 lb/cu ft.

24. The charge roll of claim 1 wherein the shaft outer diameter is about 6 mm;

the foam core layer outer diameter is about 10 mm;

the sleeve inner diameter prior to fastening to the foam core layer is about 9 mm; and the foam core layer density is about 8 lb/cu ft.

25. The charge roll of claim 1 wherein there is no primer or adhesive on the outer circumferential surface of the foam core layer or on the inner circumferential surface of the sleeve before assembly.

26. The charge roll of claim 1 wherein the sleeve is not heat shrunk.

27. A charge roll comprising:

a shaft;

a foam core layer which surrounds at least part of the circumferential surface of the shaft; and a sleeve which surrounds at least part of the circumferential surface of the foam core layer and has a length which is greater than a length of the foam core layer;

wherein the foam core layer is reticulated and coated with an electrically conductive composition, wherein the sleeve is fastened to the foam core layer by friction after the sleeve and foam core layer are pushed together, and wherein prior to fastening the foam core layer to the sleeve, the foam core layer has an outer diameter greater than the inner diameter of the sleeve.

28. A composite material comprising:

a shaft;

a foam core layer which surrounds at least part of the circumferential surface of the shaft; and a sleeve which surrounds at least part of the circumferential surface of the foam core layer and has a length which is greater than a length of the foam core layer;

wherein the foam core layer is reticulated and coated with an electrically conductive composition, wherein the sleeve is fastened to the foam core layer by interference fit, and wherein prior to fastening the foam core layer to the sleeve, the foam core layer has an outer diameter greater than the inner diameter of the sleeve.

29. An image forming apparatus comprises a charge roll and a photoconductive drum;

wherein the charge roll comprises a shaft;

a foam core layer which surrounds at least part of the circumferential surface of the shaft; and a sleeve which surrounds at least part of the circumferential surface of the foam core layer;

wherein the foam core layer is reticulated and coated with an electrically conductive composition, wherein the sleeve is fastened to the foam core layer by interference fit, and wherein prior to fastening the foam core layer to the sleeve, the foam core layer has an outer diameter greater than the inner diameter of the sleeve.

30. The image forming apparatus of claim 29 wherein the sleeve has a length which is greater than a length of the foam core by about 1 mm to about 4 mm.

31. The image forming apparatus of claim 29 wherein the image forming apparatus uses an AC/DC laser printing system or a DC only laser printing system.

32. The image forming apparatus of claim 29 wherein the charge roll does not leach damaging amounts of extractables onto the photoconductive drum.

33. The image forming apparatus of claim 29 wherein the charge roll has an enhanced charge uniformity.

* * * * *